US008740728B2

(12) United States Patent
Nakamura

(10) Patent No.: US 8,740,728 B2
(45) Date of Patent: Jun. 3, 2014

(54) GOLF BALL

(75) Inventor: Hirotaka Nakamura, Kobe (JP)

(73) Assignee: SRI Sports Limited, Kobe (JP)

( * ) Notice: Subject to any disclaimer, the term of this patent is extended or adjusted under 35 U.S.C. 154(b) by 382 days.

(21) Appl. No.: 13/290,157

(22) Filed: Nov. 7, 2011

(65) Prior Publication Data

US 2012/0165131 A1 Jun. 28, 2012

(30) Foreign Application Priority Data

Dec. 24, 2010 (JP) ..... 2010-286929

(51) Int. Cl.

| | |
|---|---|
| ***A63B 37/14*** | (2006.01) |
| *A63B 37/12* | (2006.01) |
| *A63B 37/04* | (2006.01) |
| *A63B 37/06* | (2006.01) |

(52) U.S. Cl.
USPC ..... 473/378; 473/377; 473/384

(58) Field of Classification Search
USPC ..... 473/351–384
See application file for complete search history.

(56) References Cited

U.S. PATENT DOCUMENTS

| | | | | |
|---|---|---|---|---|
| 4,681,323 | A * | 7/1987 | Alaki et al. | 473/384 |
| 4,813,677 | A | 3/1989 | Oka et al. | |
| 4,979,747 | A | 12/1990 | Jonkouski | |
| 5,016,887 | A | 5/1991 | Jonkouski | |
| 5,033,750 | A | 7/1991 | Yamagishi et al. | |
| 5,158,300 | A | 10/1992 | Aoyama | |
| 6,053,820 | A * | 4/2000 | Kasashima et al. | 473/378 |
| 6,379,268 | B1 * | 4/2002 | Yamagishi et al. | 473/371 |
| 7,134,974 | B2 * | 11/2006 | Shannon et al. | 473/378 |
| 8,048,958 | B2 * | 11/2011 | Hirau et al. | 525/129 |
| 8,388,466 | B2 * | 3/2013 | Ohama et al. | 473/377 |
| 2005/0187038 | A1 * | 8/2005 | Sasaki et al. | 473/378 |
| 2007/0117655 | A1 * | 5/2007 | Kasashima et al. | 473/371 |

* cited by examiner

*Primary Examiner* — Alvin Hunter
(74) *Attorney, Agent, or Firm* — Birch, Stewart, Kolasch & Birch, LLP.

(57) ABSTRACT

A golf ball 2 has, on a surface thereof, a plurality of types of dimples 8 having different diameters from each other. The standard deviation of the curvature radii of cross sections of all the dimples 8 is 0.90 mm or less. The average of the curvature radii of the cross sections of all the dimples 8 is greater than 40% but 50% or less of the diameter of the golf ball 2. The sum of the volumes of all the dimples 8 is 280 $mm^3$ or greater but 350 $mm^3$ or less. The average of the diameters of all the dimples 8 is 3.9 mm or greater but 4.5 mm or less. The ratio of the sum of the areas of all the dimples 8 to the surface area of a phantom sphere of the golf ball 2 is 75% or greater but 95% or less.

10 Claims, 12 Drawing Sheets

GOLF BALL

This application claims priority on Patent Application No. 2010-286929 filed in JAPAN on Dec. 24, 2010. The entire contents of this Japanese Patent Application are hereby incorporated by reference.

BACKGROUND OF THE INVENTION

1. Field of the Invention

The present invention relates to golf balls. Specifically, the present invention relates to improvement of dimples of golf balls.

2. Description of the Related Art

Golf balls have a large number of dimples on the surfaces thereof. The dimples disturb the air flow around the golf ball during flight to cause turbulent flow separation. This phenomenon is referred to as "turbulization". Due to the turbulization, separation points of the air from the golf ball shift backwards leading to a reduction of drag. The turbulization promotes the displacement between the separation point on the upper side and the separation point on the lower side of the golf ball, which results from the backspin, thereby enhancing the lift force that acts upon the golf ball. Excellent dimples efficiently disturb the air flow. The excellent dimples produce a long flight distance.

The ratio of the sum of the areas of dimples to the surface area of a phantom sphere of a golf ball is referred to as an occupation ratio. In general, in a golf ball having a high occupation ratio, the degree of turbulization is great. A golf ball having a high occupation ratio has excellent flight performance.

It is known that the degree of turbulization is great in a golf ball in which the diameters of dimples are less variable. The golf ball has excellent flight performance.

In order to increase an occupation ratio, it is necessary to locate a small-diameter dimple in a narrow zone surrounded by a plurality of dimples. The presence of the small-diameter dimple causes an increase in variation of the diameters of dimples. Increasing an occupation ratio and suppressing the variation of the diameters are incompatible with each other.

The degree of turbulization also depends on the cross-sectional shapes of dimples. In a golf ball in which dimples are too deep, turbulization is insufficient. Also in a golf ball in which dimples are too shallow, turbulization is insufficient.

There have been various proposals for the cross-sectional shapes of dimples. JPS62-192181 (U.S. Pat. No. 4,813,677) discloses a golf ball that has dimples having large diameters and large depths and dimples having small diameters and small depths.

JPH2-134175 (U.S. Pat. No. 5,033,750) discloses a golf ball in which the difference between a value obtained by dividing the diameter of a dimple by the depth thereof and a value obtained by dividing the diameter of another dimple by the depth thereof is equal to or less than 0.3.

JPH3-198875 (U.S. Pat. No. 4,979,747) discloses a golf ball that has dimples having large diameters and small depths and dimples having small diameters and large depths.

JPH4-231079 (U.S. Pat. No. 5,016,887) discloses a golf ball in which values obtained by dividing the depths of all dimples by the diameters thereof are the same.

JPH5-237202 (U.S. Pat. No. 5,158,300) discloses a golf ball in which the edge angles of all dimples are the same.

The greatest interest to golf players concerning golf balls is flight distance. In light of flight performance, there is room for improvement in the shapes of dimples. An object of the present invention is to provide a golf ball having excellent flight performance.

SUMMARY OF THE INVENTION

A golf ball according to the present invention has, on a surface thereof, a plurality of types of dimples having different diameters from each other. A standard deviation of curvature radii of cross sections of all the dimples is equal to or less than 0.90 mm. An average of the curvature radii of the cross sections of all the dimples is greater than 40% of a diameter of the golf ball but equal to or less than 50% of the diameter of the golf ball.

In the golf ball according to the present invention, since the standard deviation of the curvature radii is equal to or less than 0.9 mm, the degree of turbulization is great. In the golf ball, the average of the curvature radii is greater than 40% of the diameter of the golf ball but equal to or less than 50% of the diameter of the golf ball. Thus, when the golf ball is hit with a driver of which a head speed is equal to or greater than 40 m/s but equal to or less than 45 m/s, the degree of turbulization is particularly great. When the golf ball is hit with a driver of which a head speed is equal to or greater than 40 m/s but equal to or less than 45 m/s, a large flight distance is achieved.

Preferably, a sum of volumes of all the dimples is equal to or greater than 280 $mm^3$ but equal to or less than 350 $mm^3$.

Preferably, the sum is equal to or greater than 290 $mm^3$ but equal to or less than 330 $mm^3$.

Preferably, an average of the diameters of all the dimples is equal to or greater than 3.9 mm but equal to or less than 4.5 mm. Preferably, the average is equal to or greater than 4.0 mm but equal to or less than 4.4 mm.

Preferably, a ratio of a sum of areas of all the dimples to a surface area of a phantom sphere of the golf ball is equal to or greater than 75% but equal to or less than 95%.

DESCRIPTION OF THE PREFERRED EMBODIMENTS

The following will describe in detail the present invention, based on preferred embodiments with reference to the accompanying drawings.

Figure 1:
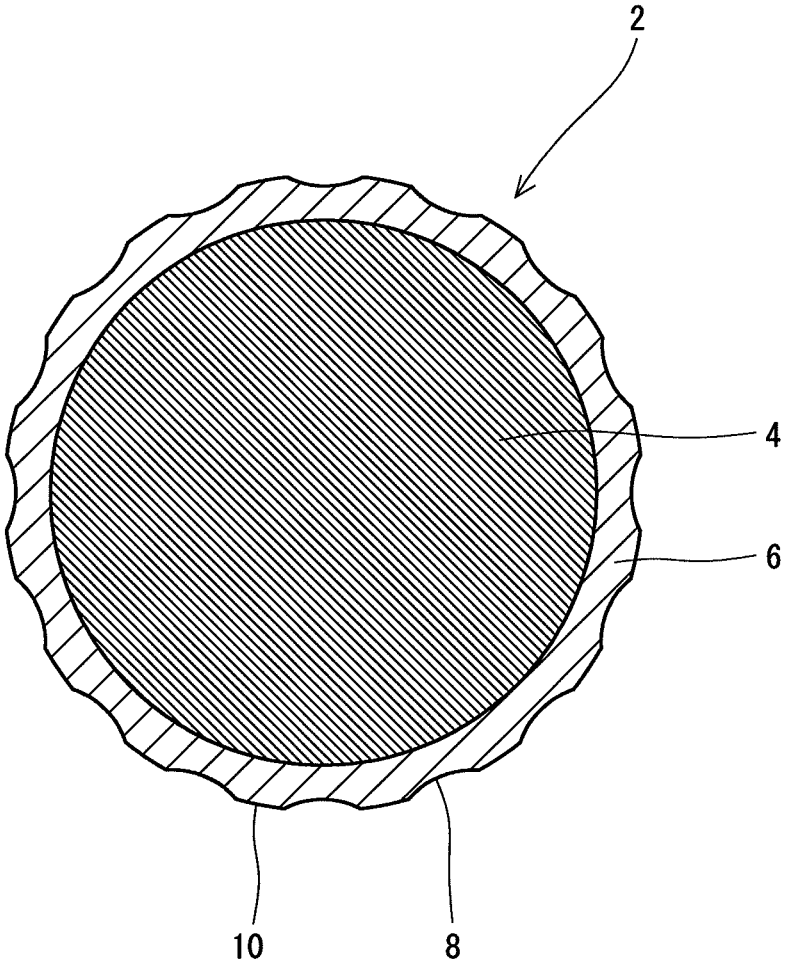
FIG. 1 is a cross-sectional view of a golf ball according to one embodiment of the present invention.

A golf ball 2 shown in FIG. 1 includes a spherical core 4 and a cover 6. On the surface of the cover 6, a large number of dimples 8 are formed. Of the surface of the golf ball 2, a part other than the dimples 8 is a land 10. The golf ball 2 includes a paint layer and a mark layer on the external side of the cover 6 although these layers are not shown in the drawing. A mid layer may be provided between the core 4 and the cover 6.

The golf ball 2 has a diameter of preferably 40 mm or greater but 45 mm or less. From the standpoint of conformity to the rules established by the United States Golf Association (USGA), the diameter is particularly preferably equal to or greater than 42.67 mm. In light of suppression of air resistance, the diameter is more preferably equal to or less than 44 mm and particularly preferably equal to or less than 42.80 mm. The golf ball 2 has a weight of preferably 40 g or greater but 50 g or less. In light of attainment of great inertia, the weight is more preferably equal to or greater than 44 g and particularly preferably equal to or greater than 45.00 g. From the standpoint of conformity to the rules established by the USGA, the weight is particularly preferably equal to or less than 45.93 g.

The core 4 is formed by crosslinking a rubber composition. Examples of base rubbers for use in the rubber composition include polybutadienes, polyisoprenes, styrene-butadiene copolymers, ethylene-propylene-diene copolymers, and natural rubbers. Two or more rubbers may be used in combination. In light of resilience performance, polybutadienes are preferred, and high-cis polybutadienes are particularly preferred.

In order to crosslink the core 4, a co-crosslinking agent is suitably used. Examples of preferable co-crosslinking agents in light of resilience performance include zinc acrylate, magnesium acrylate, zinc methacrylate, and magnesium methacrylate. The rubber composition preferably includes an organic peroxide together with a co-crosslinking agent. Examples of preferable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide.

According to need, various additives such as a filler, sulfur, a vulcanization accelerator, a sulfur compound, an anti-aging agent, a coloring agent, a plasticizer, a dispersant, and the like are included in the rubber composition of the core 4 in an adequate amount. Synthetic resin powder or crosslinked rubber powder may also be included in the rubber composition.

The core 4 has a diameter of preferably 30.0 mm or greater and particularly preferably 38.0 mm or greater. The diameter of core 4 is preferably equal to or less than 42.0 mm and particularly preferably equal to or less than 41.5 mm. The core 4 may be composed of two or more layers. The core 4 may have a rib on the surface thereof. The core 4 may be hollow.

A suitable polymer for the cover 6 is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymer and the ternary copolymer, preferable α-olefins are ethylene and propylene, while preferable α,β-unsaturated carboxylic acids are acrylic acid and methacrylic acid. In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion.

Instead of an ionomer resin, other polymers may be used for the cover 6. Examples of the other polymers include polyurethanes, polystyrenes, polyamides, polyesters, and polyolefins. In light of spin performance and scuff resistance, polyurethanes are preferred. Two or more polymers may be used in combinations.

According to need, a coloring agent such as titanium dioxide, a filler such as barium sulfate, a dispersant, an antioxidant, an ultraviolet absorber, a light stabilizer, a fluorescent material, a fluorescent brightener, and the like are included in the cover 6 in an adequate amount. For the purpose of adjusting specific gravity, powder of a metal having a high specific gravity such as tungsten, molybdenum, and the like may be included in the cover 6.

The cover 6 has a thickness of preferably 0.2 mm or greater and particularly preferably 0.3 mm or greater. The thickness of the cover 6 is preferably equal to or less than 2.5 mm and particularly preferably equal to or less than 2.2 mm. The cover 6 has a specific gravity of preferably 0.90 or greater and particularly preferably 0.95 or greater. The specific gravity of the cover 6 is preferably equal to or less than 1.10 and particularly preferably equal to or less than 1.05. The cover 6 may be composed of two or more layers.

Figure 2:
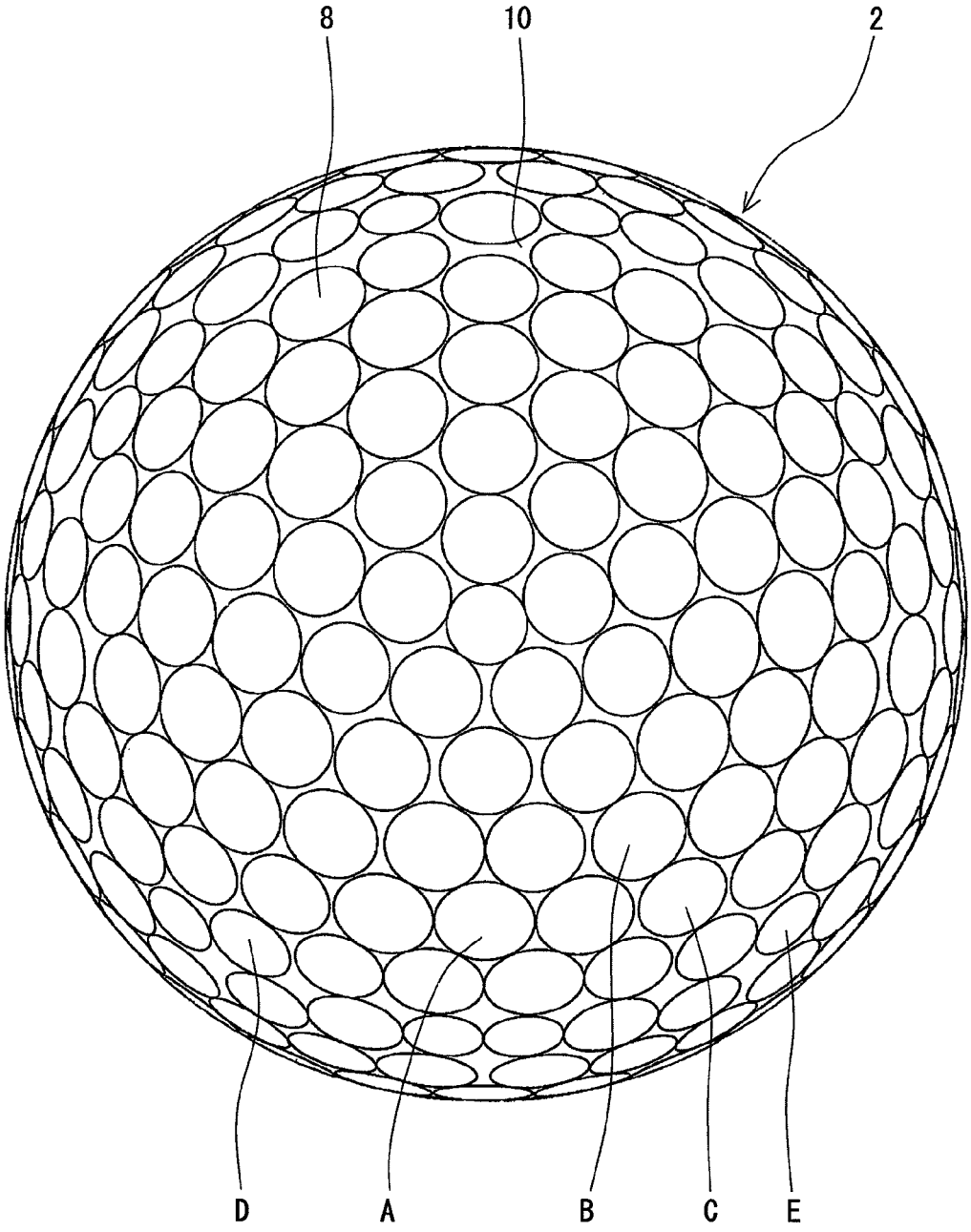
FIG. 2 is an enlarged plan view of the golf ball in FIG. 1.
Figure 3:
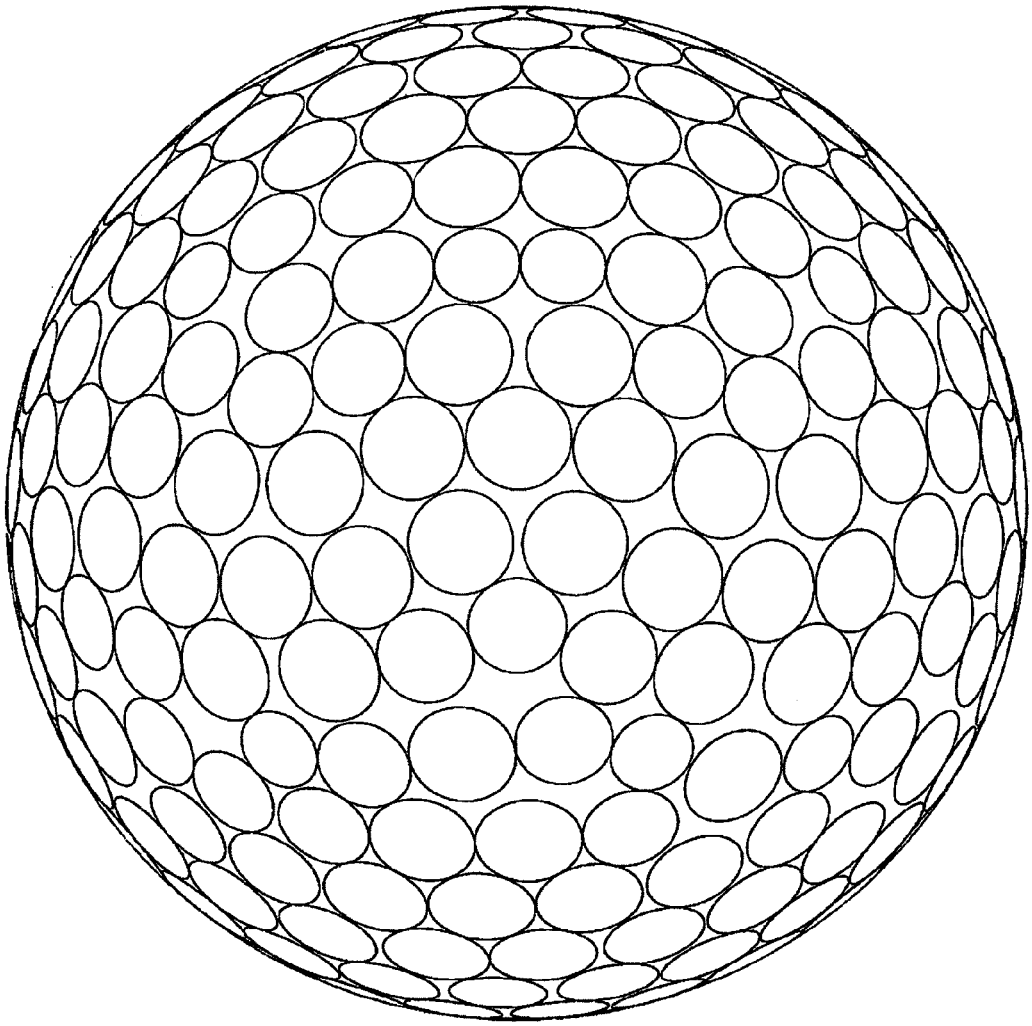
FIG. 3 is a front view of the golf ball in FIG. 2.

As shown in FIGS. 2 and 3, the contour of each dimple 8 is circular. The golf ball 2 has dimples A each having a diameter of 4.50 mm; dimples B each having a diameter of 4.40 mm; dimples C each having a diameter of 4.30 mm; dimples D each having a diameter of 4.10 mm; and dimples E each having a diameter of 3.60 mm. The number of types of the dimples 8 is five.

The number of the dimples A is 108; the number of the dimples B is 78; the number of the dimples C is 20; the number of the dimples D is 100; and the number of the dimples E is 18. The total number TN of the dimples 8 is 324.

Figure 4:
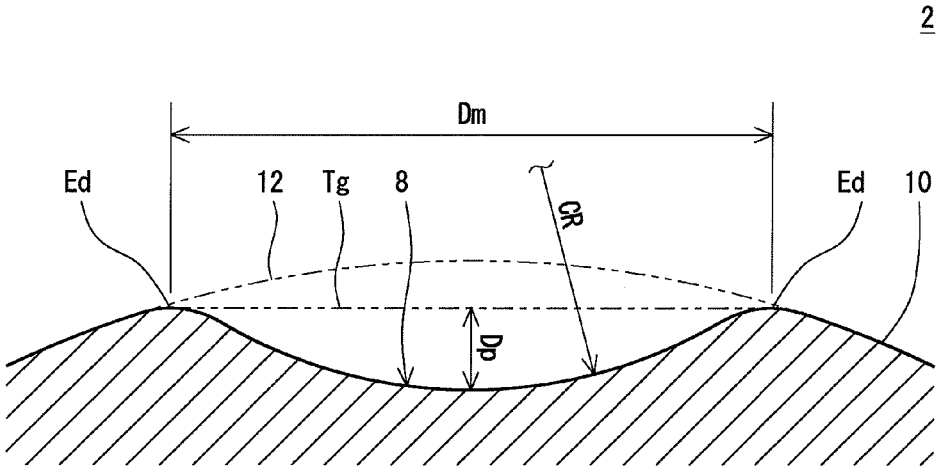
FIG. 4 is a partially enlarged cross-sectional view of the golf ball in FIG. 1.

FIG. 4 shows a cross section along a plane passing through the center of the dimple 8 and the center of the golf ball 2. In FIG. 4, the top-to-bottom direction is the depth direction of the dimple 8. In FIG. 4, what is indicated by a chain double-dashed line 12 is the surface of a phantom sphere. The surface of the phantom sphere 12 is the surface of the golf ball 2 when it is postulated that no dimple 8 exists. The dimple 8 is recessed from the surface of the phantom sphere 12. The land 10 agrees with the surface of the phantom sphere 12. In the present embodiment, the cross-sectional shape of each dimple 8 is substantially a circular arc.

In FIG. 4, what is indicated by a double ended arrow Dm is the diameter of the dimple 8. The diameter Dm is the distance between two tangent points Ed appearing on a tangent line Tg that is drawn tangent to the far opposite ends of the dimple 8. Each tangent point Ed is also the edge of the dimple 8. The edge Ed defines the contour of the dimple 8. In FIG. 4, what is indicated by a double ended arrow Dp is the depth of the dimple 8. The depth Dp is the distance between the tangent line Tg and the deepest part of the dimple 8.

In FIG. 4, what is indicated by an arrow CR is the curvature radius of the dimple 8. The curvature radius CR is calculated by the following mathematical formula (1).

$$CR=(Dp^2+Dm^2/4)/(2*Dp) \quad (1)$$

In the present embodiment, the curvature radius CR of each dimple A is 18.1 mm; the curvature radius CR of each dimple B is 18.1 mm; the curvature radius CR of each dimple C is 18.1 mm; the curvature radius CR of each dimple D is 18.1 mm; and the curvature radius CR of each dimple E is 18.1 mm. In other words, the curvature radii CR of all the dimples 8 are substantially the same. Due to processing errors of the golf ball 2 and measurement errors of the diameter Dm and the depth Dp, the curvature radius CR of each dimple 8 may be slightly different from 18.1 mm. Such a state is referred to as "substantially the same" in the present invention.

According to the finding by the inventor of the present invention, in the golf ball 2 in which the curvature radii CR of all the dimples 8 are substantially the same, the degree of turbulization is great. The golf ball 2 has excellent flight performance. Even when the curvature radii CR are equalized with each other, the diameter Dm of each type of the dimples can arbitrarily be determined. Therefore, the dimples 8 can densely be arranged. The synergistic effect of the equalized curvature radii CR and the densely arranged dimples 8 achieves excellent flight performance.

The curvature radii CR may be different for each dimple type. In this case as well, the curvature radii CR are preferably less variable. Specifically, the standard deviation a of the curvature radii CR of all the dimples 8 is preferably equal to or less than 0.90 mm. In the golf ball 2 in which the standard deviation a is equal to or less than 0.90 mm, the degree of turbulization is great. In light of turbulization, the standard deviation 6 is preferably equal to or less than 0.80 mm, more preferably equal to or less than 0.70 mm, and particularly preferably equal to or less than 0.60 mm.

The detailed reason why the golf ball 2 in which the curvature radii CR are less variable has excellent flight performance has not been identified. It is inferred that the fact that the phenomenon caused by backspin regularly occurs near separation points prompts turbulization.

In a first method for determining the standard deviation a and the average curvature radius Av of the curvature radii CR, the diameters Dm and the depths Dp of all the dimples 8 are measured. The curvature radii CR of all the dimples 8 are calculated on the basis of the above mathematical formula (1). The standard deviation σ and the average curvature radius Av are calculated on the basis of these curvature radii CR.

Instead of the first method, a second method may conveniently be used. In the second method, first, the average curvature radius Av is calculated on the basis of the following mathematical formula (2).

$$Av=(Ca*108+Cb*78+Cc*20+Cd*100+Ce*18)/324 \quad (2)$$

In the mathematical formula (2), Ca is the curvature radius of the dimple A; Cb is the curvature radius of the dimple B; Cc is the curvature radius of the dimple C; Cd is the curvature radius of the dimple D; and Ce is the curvature radius of the dimple E. Ca is calculated on the basis of the above mathematical formula (1) from measured diameters Dm and depths Dp of a plurality of dimples A that are randomly sampled. Cb is calculated on the basis of the above mathematical formula (1) from measured diameters Dm and depths Dp of a plurality of dimples B that are randomly sampled. Cc is calculated on the basis of the above mathematical formula (1) from measured diameters Dm and depths Dp of a plurality of dimples C that are randomly sampled. Cd is calculated on the basis of the above mathematical formula (1) from measured diameters Dm and depths Dp of a plurality of dimples D that are randomly sampled. Ce is calculated on the basis of the above mathematical formula (1) from measured diameters Dm and depths Dp of a plurality of dimples E that are randomly sampled. The number of the sampled dimples per dimple type is equal to or greater than 4 but equal to or less than 6.

In the second method, the standard deviation σ is calculated on the basis of the following mathematical formula (3).

$$\sigma=(((Ca-Av)^2*108+(Cb-Av)^2*78+(Cc-Av)^2*20+(Cd-Av)^2*100+(Ce-Av)^2*18)/(324-1))^{1/2} \quad (3)$$

According to the finding by the inventor of the present invention, the ratio PC of the average curvature radius Av to the diameter of the golf ball 2 influences the degree of turbulization. There is an appropriate ratio PC corresponding to a flight speed of the golf ball 2. A flight speed depends on a head speed. According to the finding by the inventor of the present invention, the golf ball 2 in which the ratio PC is greater than 40% but equal to or less than 50% is suitable for a golf player whose head speed of a driver (W#1) is equal to or greater than 40 m/s but equal to or less than 45 m/s. When this golf player hits, with a driver, the golf ball 2 in which the ratio PC is greater than 40% but equal to or less than 50%, the degree of turbulization is great. When this golf player hits, with a driver, the golf ball 2 in which the ratio PC is greater than 40% but equal to or less than 50%, a large flight distance is obtained. In light of flight distance, the ratio PC is particularly preferably equal to or greater than 42.2%. In light of flight distance, the ratio PC is more preferably equal to or less than 46.9% and particularly preferably equal to or less than 46.0%.

As described above, the golf ball 2 has the five types of the dimples 8 having different diameters from each other. From the standpoint that the dimples 8 can densely be arranged, the number of the types of the dimples 8 is preferably equal to or greater than 2, more preferably equal to or greater than 4, and particularly preferably equal to or greater than 5.

The diameter Dm of each dimple 8 is preferably equal to or greater than 2.0 mm but equal to or less than 6.0 mm. The dimple 8 having a diameter Dm of 2.0 mm or greater contributes to turbulization. In this respect, the diameter Dm is more preferably equal to or greater than 2.4 mm and particularly preferably equal to or greater than 2.8 mm. In the golf ball 2 in which the diameter Dm is equal to or less than 6.0 mm, a fundamental feature of the golf ball 2 being substantially a sphere is not impaired. In this respect, the diameter Dm is more preferably equal to or less than 5.6 mm and particularly preferably equal to or less than 5.2 mm.

The golf ball 2 in which the diameter Dm of each dimple 8 is equal to or greater than 3.3 mm but equal to or less than 5.0 mm is suitable for a golf player whose head speed of a driver is equal to or greater than 40 m/s but equal to or less than 45 m/s. When this golf player hits, with a driver, the golf ball 2 in which the diameter Dm is equal to or greater than 3.3 mm but equal to or less than 5.0 mm, the degree of turbulization is great. When this golf player hits, with a driver, the golf ball 2 in which the diameter Dm is equal to or greater than 3.3 mm but equal to or less than 5.0 mm, a large flight distance is obtained.

The average diameter of the dimples 8 is preferably equal to or greater than 3.9 mm but equal to or less than 4.5 mm. The golf ball 2 in which the average diameter is within this range is suitable for a golf player whose head speed of a driver is equal to or greater than 40 m/s but equal to or less than 45 m/s. When this golf player hits, with a driver, the golf ball 2 in which the average diameter is equal to or greater than 3.9 mm but equal to or less than 4.5 mm, the degree of turbulization is great. When this golf player hits, with a driver, the golf ball 2 in which the average diameter is equal to or greater than 3.9 mm but equal to or less than 4.5 mm, a large flight distance is obtained. In light of flight distance, the average diameter is particularly preferably equal to or greater than 4.0 mm. In light of flight distance, the average diameter is particularly preferably equal to or less than 4.4 mm.

The area s of the dimple 8 is the area of a region surrounded by the contour line when the center of the golf ball 2 is viewed at infinity. In the case of a circular dimple 8, the area s is calculated by the following mathematical formula.

$$s=(Dm/2)^2*\pi$$

In the golf ball 2 shown in FIGS. 2 and 3, the area of each dimple A is 15.90 $mm^2$; the area of each dimple B is 15.21

$mm^2$; the area of each dimple C is 14.52 $mm^2$; the area of each dimple D is 13.20 $mm^2$; and the area of each dimple E is 10.18 $mm^2$.

The ratio of the sum of the areas s of all the dimples 8 to the surface area of the phantom sphere 12 is referred to as an occupation ratio. In light of turbulization, the occupation ratio is preferably equal to or greater than 75%, more preferably equal to or greater than 80%, and particularly preferably equal to or greater than 81.8%. The occupation ratio is preferably equal to or less than 95%. In the golf ball 2 shown in FIGS. 2 and 3, the total area of all the dimples 8 is 4697.2 $mm^2$. The surface area of the phantom sphere 12 of the golf ball 2 is 5741.5 $mm^2$, and thus the occupation ratio is 81.8%.

In the present invention, the term "dimple volume" means the volume of a part surrounded by the surface of the dimple 8 and a plane that includes the contour of the dimple 8. In light of suppression of rising of the golf ball 2 during flight, the total volume of all the dimples 8 is preferably equal to or greater than 250 $mm^3$, more preferably equal to or greater than 280 $mm^3$, and particularly preferably equal to or greater than 290 $mm^3$. In light of suppression of dropping of the golf ball 2 during flight, the total volume is preferably equal to or less than 380 $mm^3$, more preferably equal to or less than 350 $mm^3$, and particularly preferably equal to or less than 330 $mm^3$.

The golf ball 2 in which the total volume is equal to or greater than 290 $mm^3$ but equal to or less than 330 $mm^3$ is suitable for a golf player whose head speed of a driver is equal to or greater than 40 m/s but equal to or less than 45 m/s. When this golf player hits, with a driver, the golf ball 2 in which the total volume is equal to or greater than 290 $mm^3$ but equal to or less than 330 $mm^3$, the degree of turbulization is great. When this golf player hits, with a driver, the golf ball 2 in which the total volume is equal to or greater than 290 $mm^3$ but equal to or less than 330 $mm^3$, a large flight distance is obtained.

In light of being able to contribute to turbulization, the depth Dp is preferably equal to or greater than 0.05 mm, more preferably equal to or greater than 0.06 mm, and particularly preferably equal to or greater than 0.07 mm. In light of suppression of dropping of the golf ball 2 during flight, the depth Dp is preferably equal to or less than 0.24 mm, more preferably equal to or less than 0.21 mm, and particularly preferably equal to or less than 0.19 mm.

The golf ball 2 in which the total number TN of the dimples 8 is equal to or greater than 240 but equal to or less than 450 is suitable for a golf player whose head speed of a driver is equal to or greater than 40 m/s but equal to or less than 45 m/s. When this player hits, with a driver, the golf ball 2 in which the total number TN is equal to or greater than 240 but equal to or less than 450, the degree of turbulization is great. When this player hits, with a driver, the golf ball 2 in which the total number TN is equal to or greater than 240 but equal to or less than 450, a large flight distance is obtained. The total number TN is particularly preferably equal to or greater than 270. The total number TN is more preferably equal to or less than 400 and particularly preferably equal to or less than 350.

The cross-sectional shape of each dimple 8 is preferably an inwardly convex arc. However, the dimple 8 may have an outwardly convex curved surface near the edge Ed. In a zone equal to or greater than 90% of the surface area of the dimple 8, the cross-sectional shape is preferably an inwardly convex arc.

EXAMPLES

Example 1

A rubber composition was obtained by kneading 100 parts by weight of a polybutadiene (trade name "BR-730", manufactured by JSR Corporation), 30 parts by weight of zinc diacrylate, 6 parts by weight of zinc oxide, 10 parts by weight of barium sulfate, 0.5 parts by weight of diphenyl disulfide, and 0.5 parts by weight of dicumyl peroxide. This rubber composition was placed into a mold including upper and lower mold halves each having a hemispherical cavity, and heated at 170° C. for 18 minutes to obtain a core with a diameter of 39.75 mm. A resin composition was obtained by kneading 50 parts by weight of an ionomer resin (trade name "Himilan 1605", manufactured by Du Pont-MITSUI POLYCHEMICALS Co., Ltd.), 50 parts by weight of another ionomer resin (trade name "Himilan 1706", manufactured by Du Pont-MITSUI POLYCHEMICALS Co., Ltd.), and 3 parts by weight of titanium dioxide. The above core was placed into a final mold having a large number of pimples on its inside face, and the above resin composition was injected around the core by injection molding to form a cover with a thickness of 1.5 mm. Dimples having a shape that is the inverted shape of the pimples were formed on the cover. A clear paint including a two-component curing type polyurethane as a base material was applied to this cover to obtain a golf ball of Example 1 with a diameter of 42.75 mm and a weight of about 45.4 g. The golf ball has a PGA compression of about 85. The golf ball has a dimple pattern shown in FIGS. 2 and 3. The detailed specifications of the dimples are shown in Table 1 below.

Examples 2 to 6 and Comparative Examples 1 to 7

Golf balls of Examples 2 to 6 and Comparative Examples 1 to 7 were obtained in the same method as Example 1, except the final mold was changed. The detailed specifications of the dimples are shown in Tables 1 to 3 below.

TABLE 1

Specifications of Dimples

| | Type | Number of dimples | Diameter Dm (mm) | Depth Dp (mm) | Curvature radius CR (mm) | Volume ($mm^3$) |
|---|---|---|---|---|---|---|
| Example 1 | A | 108 | 4.50 | 0.1408 | 18.1 | 1.121 |
| | B | 78 | 4.40 | 0.1346 | 18.1 | 1.024 |
| | C | 20 | 4.30 | 0.1285 | 18.1 | 0.934 |
| | D | 100 | 4.10 | 0.1167 | 18.1 | 0.772 |
| | E | 18 | 3.60 | 0.0899 | 18.1 | 0.458 |
| Example 2 | A | 108 | 4.50 | 0.1293 | 19.6 | 1.029 |
| | B | 78 | 4.40 | 0.1235 | 19.6 | 0.940 |
| | C | 20 | 4.30 | 0.1180 | 19.6 | 0.858 |
| | D | 100 | 4.10 | 0.1072 | 19.6 | 0.708 |
| | E | 18 | 3.60 | 0.0826 | 19.6 | 0.421 |
| Compara. Example 1 | A | 108 | 4.50 | 0.1523 | 16.7 | 1.213 |
| | B | 78 | 4.40 | 0.1456 | 16.7 | 1.109 |
| | C | 20 | 4.30 | 0.1391 | 16.7 | 1.011 |
| | D | 100 | 4.10 | 0.1263 | 16.7 | 0.835 |
| | E | 18 | 3.60 | 0.0973 | 16.7 | 0.496 |
| Compara. Example 2 | A | 108 | 4.50 | 0.1297 | 19.6 | 1.033 |
| | B | 78 | 4.40 | 0.1297 | 18.7 | 0.987 |
| | C | 20 | 4.30 | 0.1297 | 17.9 | 0.943 |
| | D | 100 | 4.10 | 0.1297 | 16.3 | 0.857 |
| | E | 18 | 3.60 | 0.1297 | 12.6 | 0.661 |
| Compara. Example 3 | A | 108 | 4.50 | 0.1353 | 18.8 | 1.077 |
| | B | 78 | 4.40 | 0.1323 | 18.4 | 1.007 |
| | C | 20 | 4.30 | 0.1293 | 17.9 | 0.940 |
| | D | 100 | 4.10 | 0.1233 | 17.1 | 0.815 |
| | E | 18 | 3.60 | 0.1083 | 15.0 | 0.552 |

TABLE 2

| Specifications of Dimples | | | | | | |
|---|---|---|---|---|---|---|
| | Type | Number of dimples | Diameter Dm (mm) | Depth Dp (mm) | Curvature radius CR (mm) | Volume ($mm^3$) |
| Example 3 | A | 40 | 4.65 | 0.1353 | 20.1 | 1.150 |
| | B | 70 | 4.55 | 0.1295 | 20.1 | 1.054 |
| | C | 40 | 4.45 | 0.1239 | 20.1 | 0.964 |
| | D | 110 | 4.30 | 0.1157 | 20.1 | 0.841 |
| | E | 20 | 4.15 | 0.1077 | 20.1 | 0.729 |
| | F | 40 | 3.90 | 0.0951 | 20.1 | 0.568 |
| | G | 12 | 2.85 | 0.0507 | 20.1 | 0.162 |
| Compara. Example 4 | A | 40 | 4.65 | 0.1192 | 22.7 | 1.013 |
| | B | 70 | 4.55 | 0.1192 | 21.8 | 0.970 |
| | C | 40 | 4.45 | 0.1192 | 20.8 | 0.928 |
| | D | 110 | 4.30 | 0.1192 | 19.4 | 0.866 |
| | E | 20 | 4.15 | 0.1192 | 18.1 | 0.807 |
| | F | 40 | 3.90 | 0.1192 | 16.0 | 0.713 |
| | G | 12 | 2.85 | 0.1192 | 8.6 | 0.381 |
| Compara. Example 5 | A | 20 | 4.40 | 0.1717 | 14.2 | 1.308 |
| | B | 160 | 4.05 | 0.1452 | 14.2 | 0.937 |
| | C | 200 | 3.90 | 0.1347 | 14.2 | 0.806 |
| | D | 12 | 2.90 | 0.0743 | 14.2 | 0.246 |
| Compara. Example 6 | A | 132 | 3.90 | 0.1772 | 10.8 | 1.061 |
| | B | 180 | 3.53 | 0.1450 | 10.8 | 0.711 |
| | C | 60 | 3.20 | 0.1190 | 10.8 | 0.480 |
| | D | 60 | 3.03 | 0.1066 | 10.8 | 0.385 |

TABLE 3

| Specifications of Dimples | | | | | | |
|---|---|---|---|---|---|---|
| | Type | Number of dimples | diameter Dm (mm) | Depth Dp (mm) | Curvature radius CR (mm) | Volume ($mm^3$) |
| Compara. Example 7 | A | 18 | 5.50 | 0.1722 | 22.0 | 2.048 |
| | B | 42 | 5.00 | 0.1422 | 22.0 | 1.398 |
| | C | 84 | 4.90 | 0.1365 | 22.0 | 1.289 |
| | D | 30 | 4.30 | 0.1051 | 22.0 | 0.764 |
| | E | 60 | 4.20 | 0.1002 | 22.0 | 0.695 |
| | F | 36 | 3.90 | 0.0864 | 22.0 | 0.516 |
| | G | 24 | 2.75 | 0.0429 | 22.0 | 0.127 |
| Example 4 | A | 108 | 4.50 | 0.1360 | 18.7 | 1.083 |
| | B | 78 | 4.40 | 0.1330 | 18.3 | 1.012 |
| | C | 20 | 4.30 | 0.1290 | 18.0 | 0.938 |
| | D | 100 | 4.10 | 0.1220 | 17.3 | 0.806 |
| | E | 18 | 3.60 | 0.1058 | 15.4 | 0.539 |
| Example 5 | A | 108 | 4.50 | 0.1438 | 17.7 | 1.145 |
| | B | 78 | 4.40 | 0.1365 | 17.8 | 1.039 |
| | C | 20 | 4.30 | 0.1283 | 18.1 | 0.933 |
| | D | 100 | 4.10 | 0.1129 | 18.7 | 0.746 |
| | E | 18 | 3.60 | 0.0765 | 21.2 | 0.390 |
| Example 6 | A | 108 | 4.50 | 0.1378 | 18.4 | 1.097 |
| | B | 78 | 4.40 | 0.1340 | 18.1 | 1.020 |
| | C | 20 | 4.30 | 0.1287 | 18.0 | 0.936 |
| | D | 100 | 4.10 | 0.1195 | 17.6 | 0.790 |
| | E | 18 | 3.60 | 0.1010 | 16.1 | 0.515 |

[Flight Distance Test]

A driver with a titanium head (trade name "XXIO", manufactured by SRI Sports Limited, shaft hardness: S, loft angle: 10.0°) was attached to a swing machine manufactured by True Temper Co. A golf ball was hit under the condition of a head speed of 45 m/sec, and the distance from the launch point to the stop point was measured. At the test, the weather was almost windless. The average value of data obtained by 12 measurements is shown in Tables 4 to 6 below.

TABLE 4

| Results of Evaluation | | | | | |
|---|---|---|---|---|---|
| | Example 1 | Example 2 | Compa. Example 1 | Compa. Example 2 | Compa. Example 3 |
| Plan view | FIG. 2 | FIG. 2 | FIG. 2 | FIG. 2 | FIG. 2 |
| Front view | FIG. 3 | FIG. 3 | FIG. 3 | FIG. 3 | FIG. 3 |
| Number of types of dimples | 5 | 5 | 5 | 5 | 5 |
| Total number TN | 324 | 324 | 324 | 324 | 324 |
| Average curvature radius Av (mm) | 18.1 | 19.6 | 16.7 | 17.9 | 17.9 |
| Standard deviation σ (mm) | 0 * | 0 * | 0 * | 1.88 | 0.98 |
| Ratio PC (%) | 42.2 | 46.0 | 39.1 | 41.8 | 41.9 |
| Total volume ($mm^3$) | 305 | 280 | 330 | 305 | 305 |
| Average diameter (mm) | 4.29 | 4.29 | 4.29 | 4.29 | 4.29 |
| Occupation ratio (%) | 81.8 | 81.8 | 81.8 | 81.8 | 81.8 |
| Flight distance (m) | 229.5 | 228.5 | 226.0 | 223.5 | 225.0 |

* Substantially zero

TABLE 5

Figure 5:
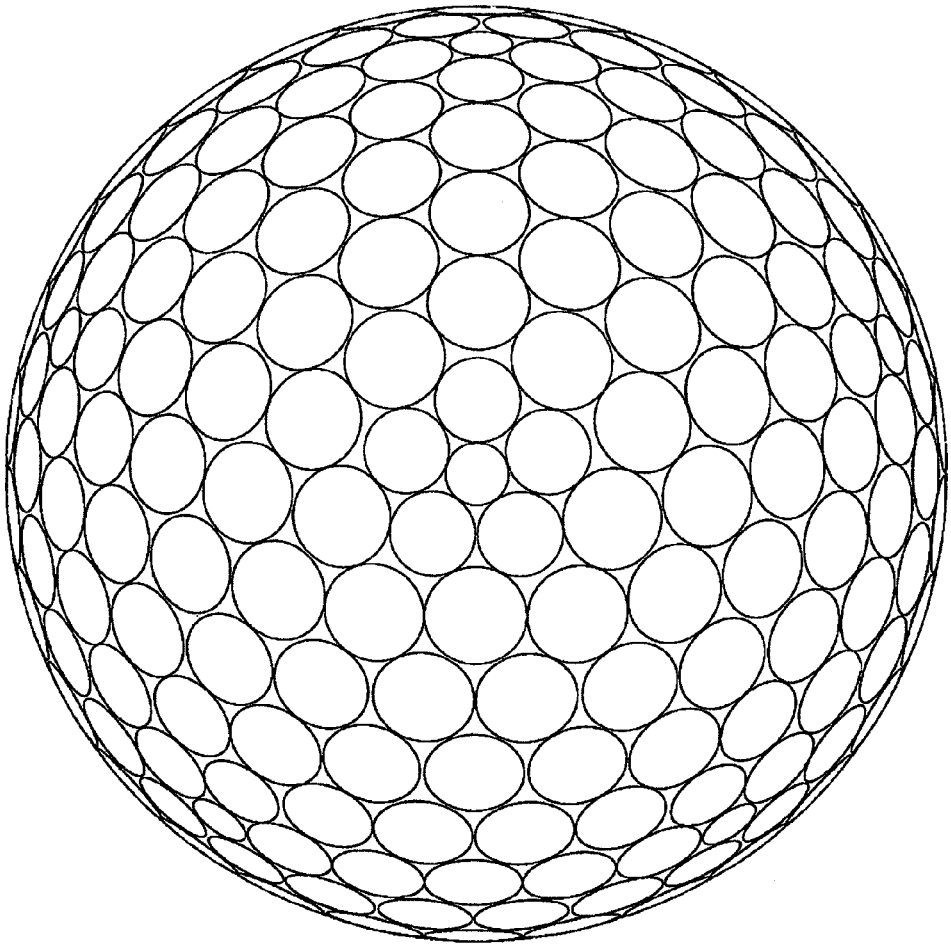
FIG. 5 is a plan view of a golf ball according to Example 3 of the present invention.
Figure 6:
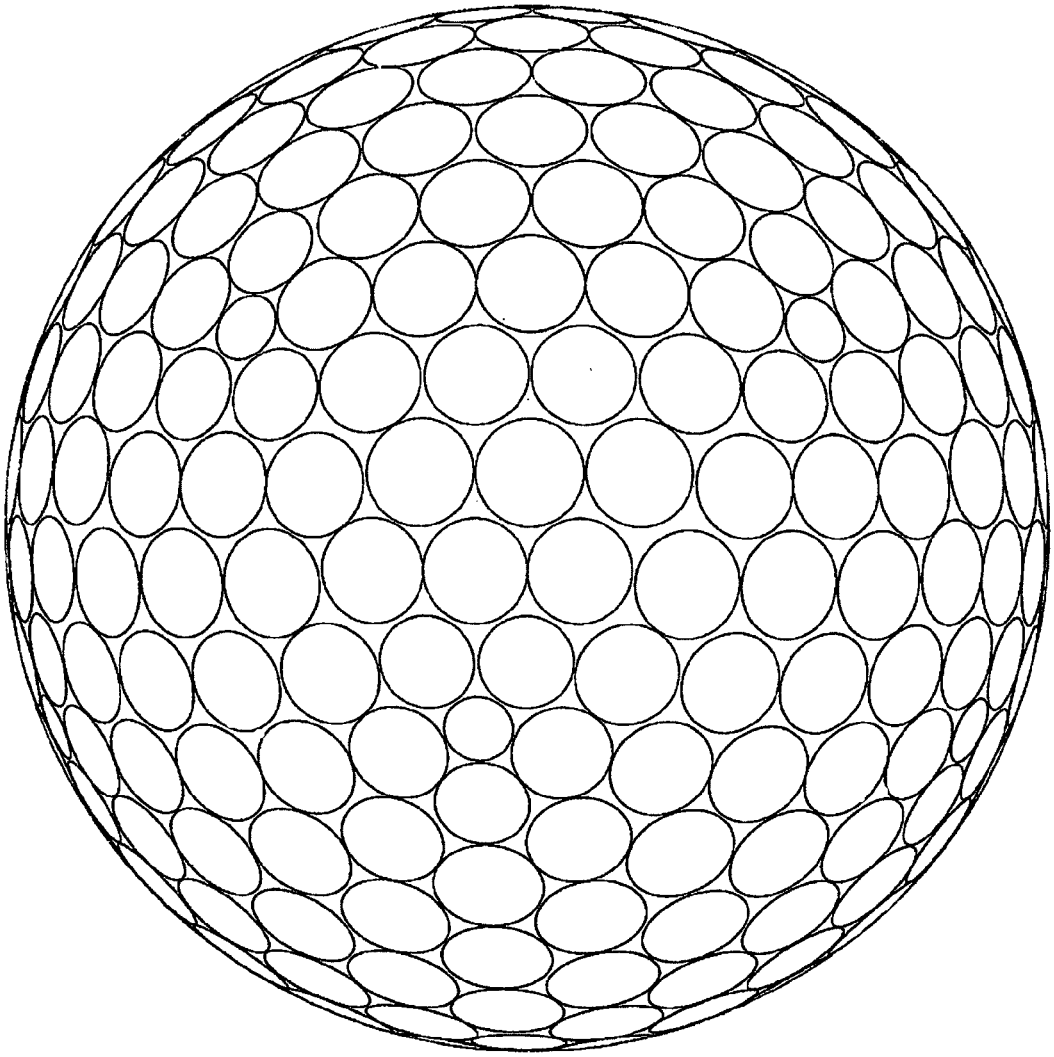
FIG. 6 is a front view of the golf ball in FIG. 5.
Figure 7:
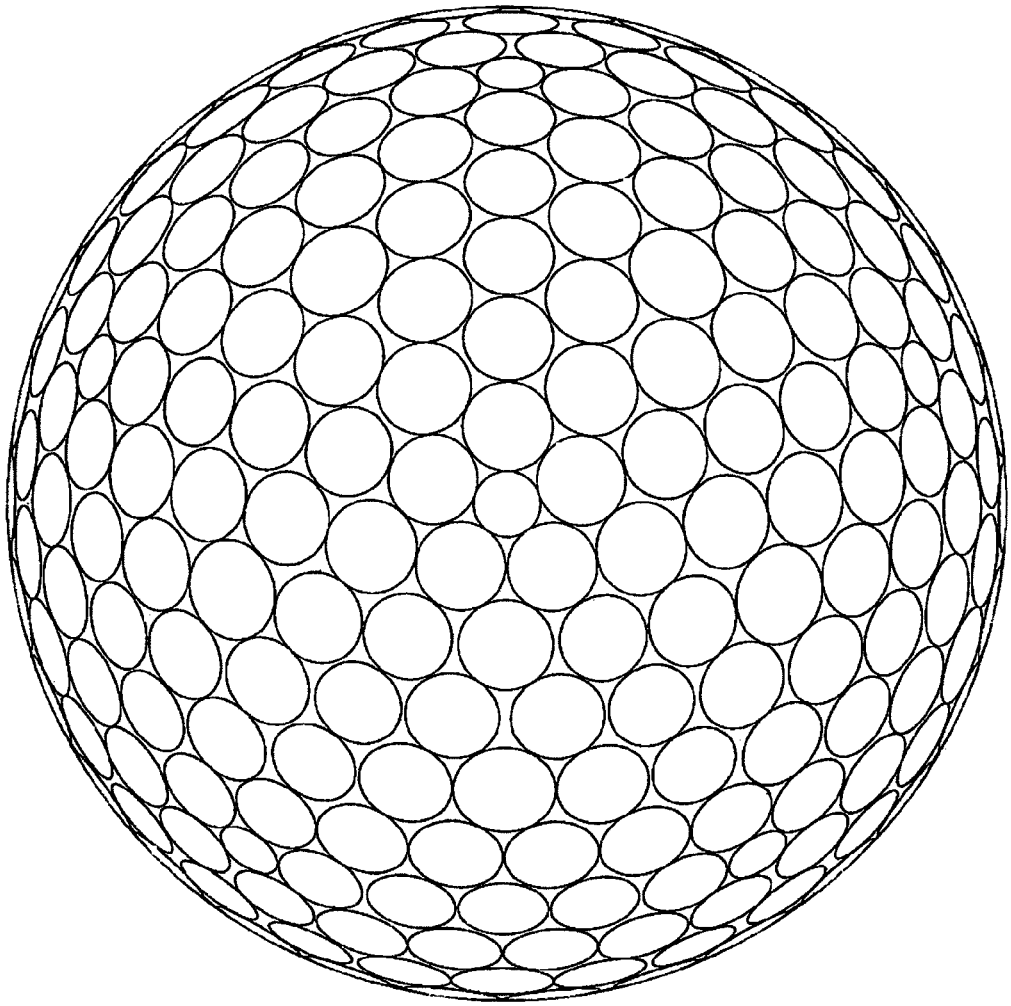
FIG. 7 is a plan view of a golf ball according to Comparative Example 5.
Figure 8:
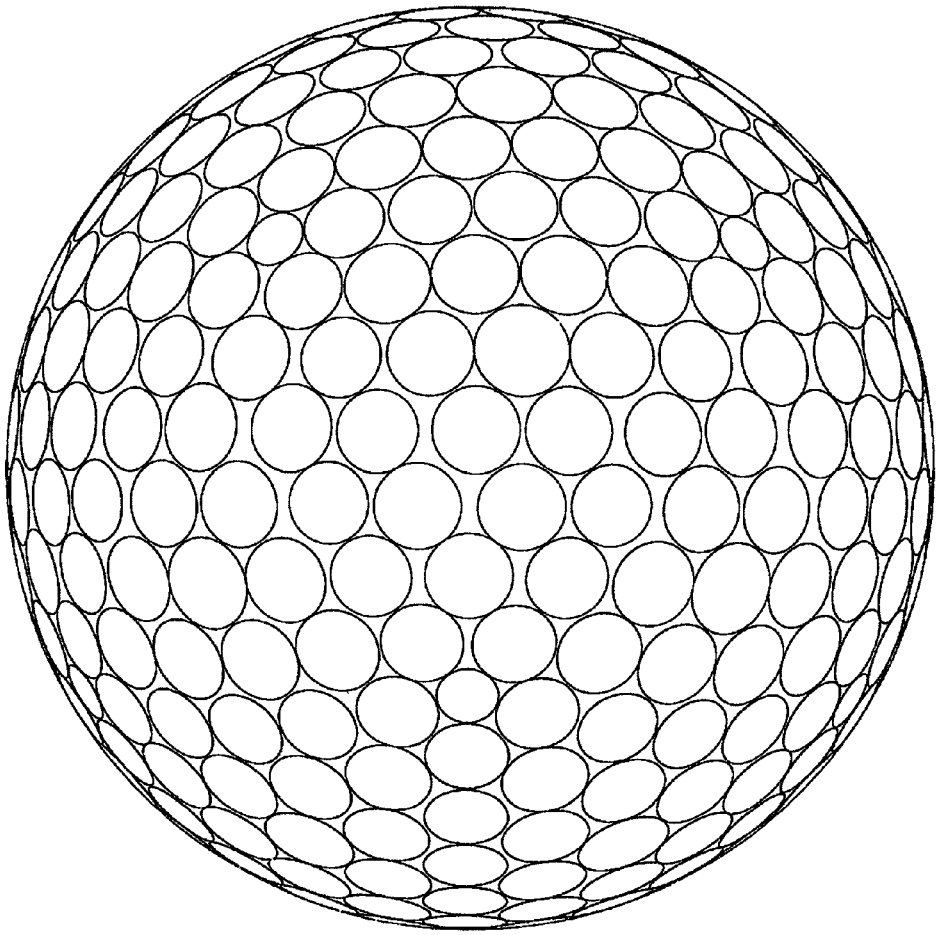
FIG. 8 is a front view of the golf ball in FIG. 7.
Figure 9:
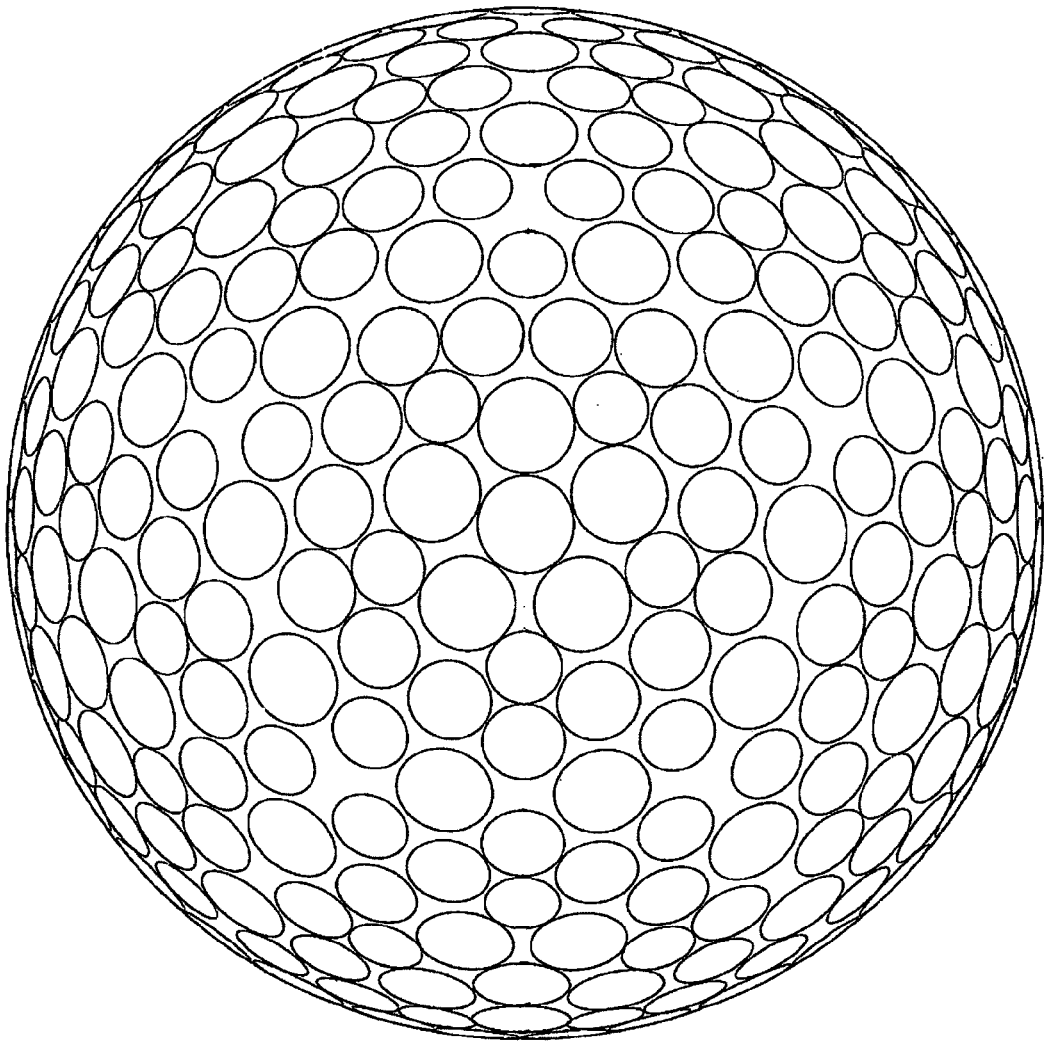
FIG. 9 is a plan view of a golf ball according to Comparative Example 6.
Figure 10:
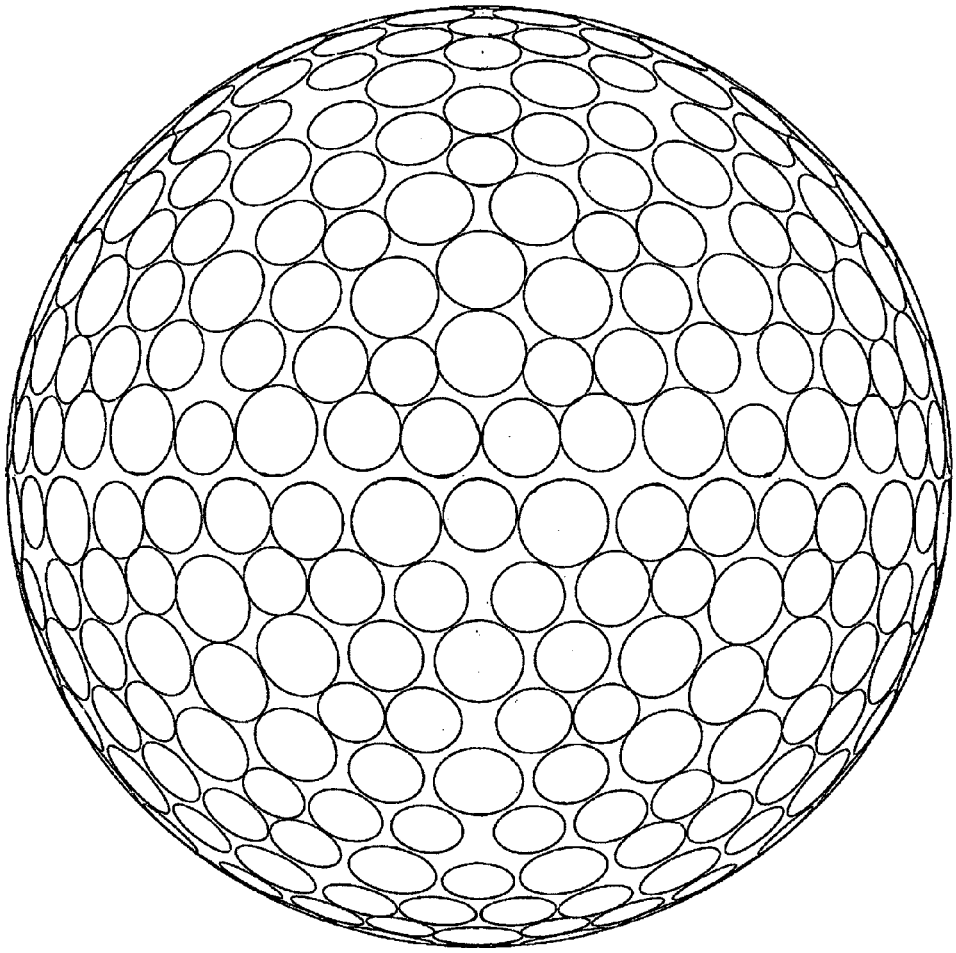
FIG. 10 is a front view of the golf ball in FIG. 9.

| Results of Evaluation | | | | |
|---|---|---|---|---|
| | Example 3 | Compa. Example 4 | Compa. Example 5 | Compa. Example 6 |
| Plan view | FIG. 5 | FIG. 5 | FIG. 7 | FIG. 9 |
| Front view | FIG. 6 | FIG. 6 | FIG. 8 | FIG. 10 |
| Number of types of dimples | 7 | 7 | 4 | 4 |
| Total number TN | 332 | 332 | 392 | 432 |
| Average curvature radius Av (mm) | 20.1 | 19.6 | 14.2 | 10.8 |
| Standard deviation σ (mm) | 0 * | 2.95 | 0 * | 0 * |
| Ratio PC (%) | 46.9 | 45.9 | 33.2 | 25.3 |
| Total volume ($mm^3$) | 290 | 290 | 340 | 325 |
| Average diameter (mm) | 4.30 | 4.30 | 3.96 | 3.53 |
| Occupation ratio (%) | 84.7 | 84.7 | 84.2 | 74.1 |
| Flight distance (m) | 228.0 | 223.0 | 225.5 | 225.0 |

* Substantially zero

TABLE 6

Figure 11:
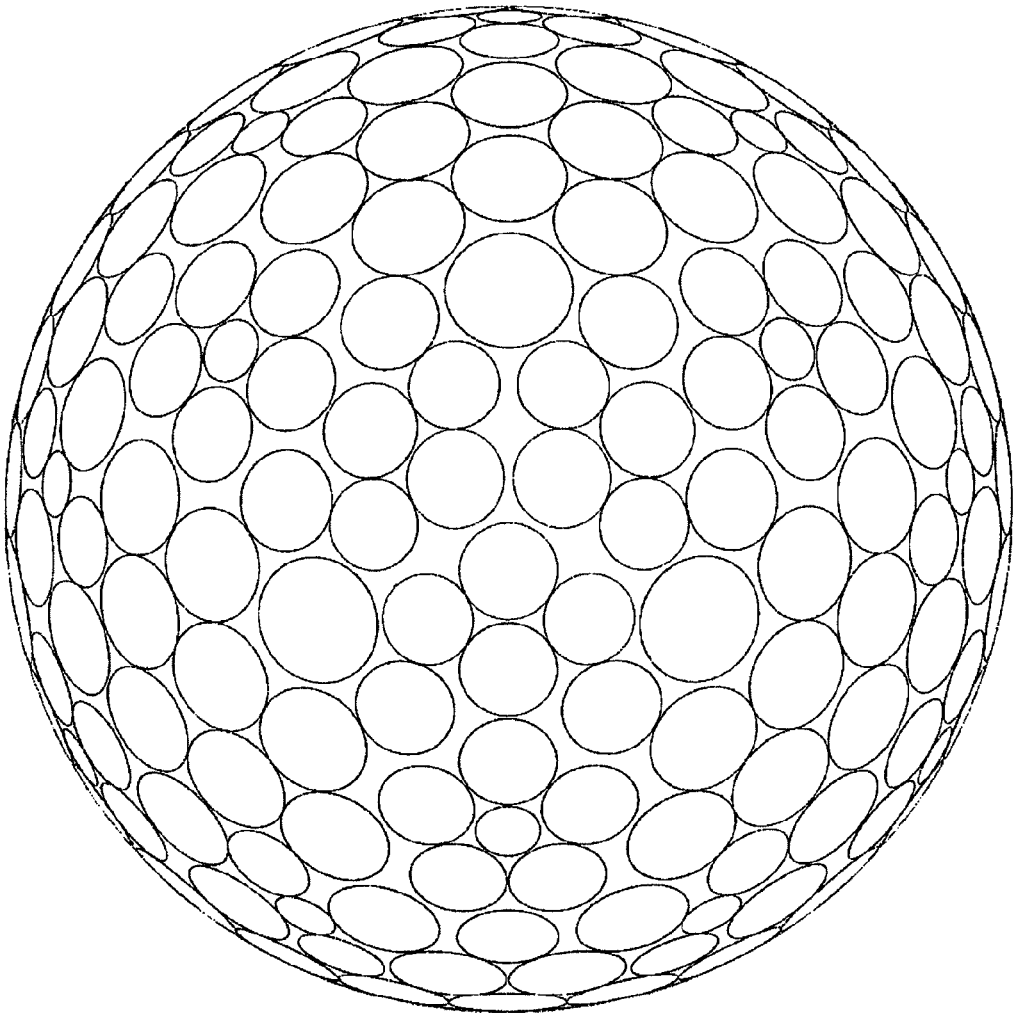
FIG. 11 is a plan view of a golf ball according to Comparative Example 7.
Figure 12:
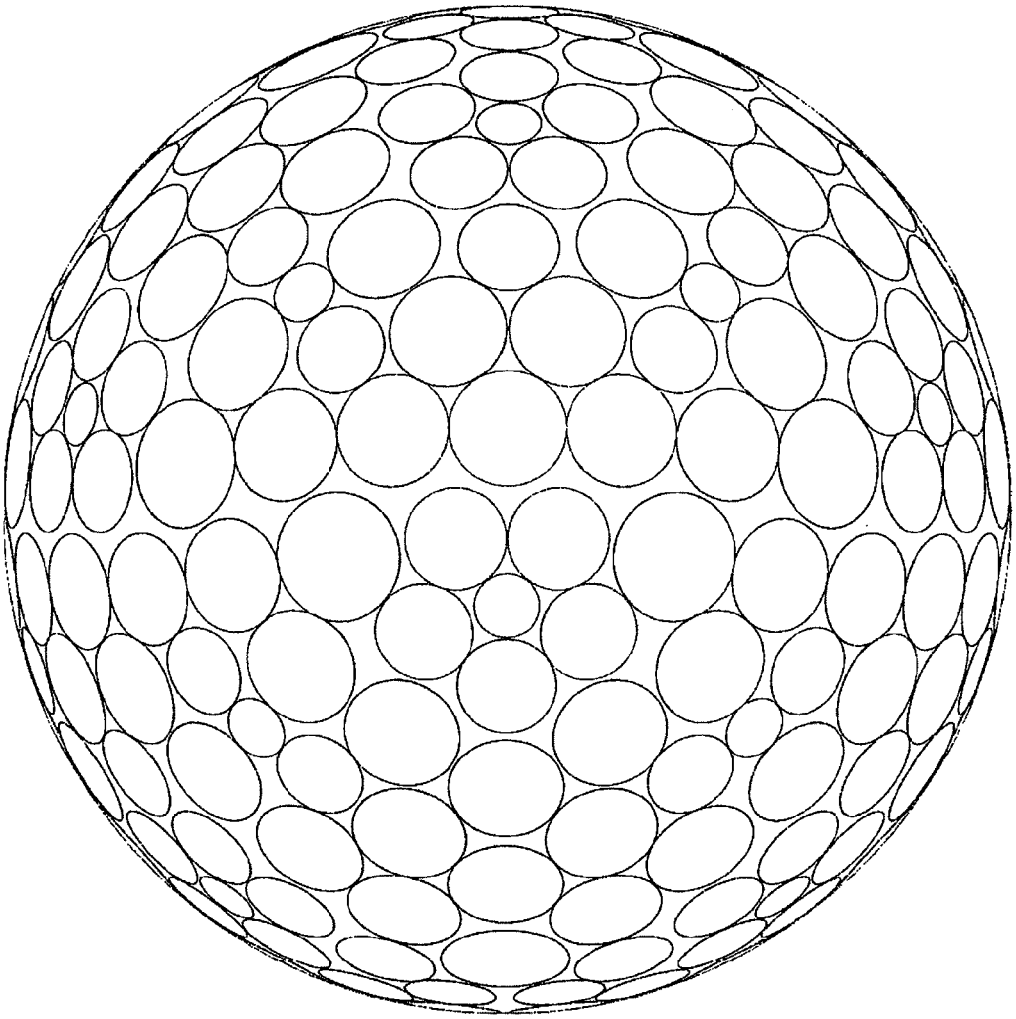
FIG. 12 is a front view of the golf ball in FIG. 11.

| Results of Evaluation | | | | |
|---|---|---|---|---|
| | Compa. Example 7 | Example 4 | Example 5 | Example 6 |
| Plan view | FIG. 11 | FIG. 2 | FIG. 2 | FIG. 2 |
| Front view | FIG. 12 | FIG. 3 | FIG. 3 | FIG. 3 |
| Number of types of dimples | 7 | 5 | 5 | 5 |
| Total number TN | 294 | 324 | 324 | 324 |
| Average curvature radius Av (mm) | 22.0 | 17.9 | 18.2 | 18.0 |
| Standard deviation σ (mm) | 0 * | 0.84 | 0.84 | 0.56 |
| Ratio PC (%) | 51.5 | 41.9 | 42.6 | 42.0 |
| Total volume ($mm^3$) | 290 | 305 | 305 | 305 |
| Average diameter (mm) | 4.45 | 4.29 | 4.29 | 4.29 |
| Occupation ratio (%) | 81.4 | 81.8 | 81.8 | 81.8 |
| Flight distance (m) | 226.5 | 227.0 | 227.5 | 228.0 |

* Substantially zero

As shown in Tables 4 to 6, the golf ball of each Example has excellent flight performance. From the results of evaluation, advantages of the present invention are clear.

The aforementioned dimples are applicable to a one-piece golf ball, a multi-piece golf ball, and a thread-wound golf ball, in addition to a three-piece golf ball. The above descriptions are merely for illustrative examples, and various modifications can be made without departing from the principles of the present invention.

What is claimed is:

1. A golf ball having, on a surface thereof, a plurality of types of dimples having different diameters from each other, wherein a standard deviation of curvature radii of cross sections of all the dimples is equal to or less than 0.90 mm, and an average of the curvature radii of the cross sections of all the dimples is greater than 40% of a diameter of the golf ball but equal to or less than 50% of the diameter of the golf ball.

2. The golf ball according to claim 1, wherein the average of the curvature radii of the cross sections of all the dimples is equal to or greater than 42.2% of the diameter of the golf ball but equal to or less than 46.9% of the diameter of the golf ball.

3. The golf ball according to claim 1, wherein a sum of volumes of all the dimples is equal to or greater than 280 $mm^3$ but equal to or less than 350 $mm^3$.

4. The golf ball according to claim 3, wherein the sum is equal to or greater than 290 $mm^3$ but equal to or less than 330 $mm^3$.

5. The golf ball according to claim 1, wherein an average of the diameters of all the dimples is equal to or greater than 3.9 mm but equal to or less than 4.5 mm.

6. The golf ball according to claim 5, wherein the average is equal to or greater than 4.0 mm but equal to or less than 4.4 mm.

7. The golf ball according to claim 1, wherein the diameter of each dimple is equal to or greater than 3.3 mm but equal to or less than 5.0 mm.

8. The golf ball according to claim 1, wherein a ratio of a sum of areas of all the dimples to a surface area of a phantom sphere of the golf ball is equal to or greater than 75% but equal to or less than 95%.

9. The golf ball according to claim 1, wherein a depth of each dimple is equal to or greater than 0.05 mm but equal to or less than 0.24 mm.

10. The golf ball according to claim 1, wherein a total number of the dimples is equal to or greater than 270 but equal to or less than 350.

* * * * *